US005316581A

United States Patent [19]

Staniszewski

[11] Patent Number: 5,316,581

[45] Date of Patent: May 31, 1994

[54] LIQUID APPLICATOR TO ACTIVATE ADHESIVE

[76] Inventor: Tadeusz Staniszewski, 33 Karen Pl., Budd Lake, N.J. 07828

[21] Appl. No.: 944,304

[22] Filed: Sep. 14, 1992

[51] Int. Cl.[5] ..... B05C 1/02; B05C 11/105

[52] U.S. Cl. ..... 118/246; 118/260; 118/264; 118/268; 401/193; 401/197; D19/70; 15/104.92

[58] Field of Search ..... 118/246, 260, 264, 268; 156/442.2, DIG. 35, 441.5; 401/21, 193, 197; 15/104.92; D19/70

[56] References Cited

U.S. PATENT DOCUMENTS

| | | | |
|---|---|---|---|
| Re. 18,588 | 9/1932 | Switzer | 118/264 |
| D. 247,231 | 2/1978 | Solidum et al. | D19/70 |
| 328,743 | 10/1885 | Allin | 15/104.92 |
| 595,491 | 12/1897 | Moseley | 118/268 |
| 703,771 | 7/1902 | Duncan | 118/268 |
| 781,136 | 1/1905 | Duncan | 118/246 |
| 784,616 | 3/1905 | Crowther | 118/246 |
| 1,612,772 | 12/1926 | Storck | 118/268 |
| 2,117,272 | 5/1938 | Brooks | 118/246 |
| 2,405,804 | 8/1946 | Zint | 118/268 |
| 2,556,003 | 6/1948 | Sandell et al. | 15/104.92 |
| 2,743,470 | 5/1956 | Horowitz | 118/264 |
| 2,760,464 | 8/1956 | Roggenburger | 118/264 |
| 2,908,246 | 10/1959 | Alexander et al. | 118/268 |
| 4,428,794 | 1/1984 | Hayskar et al. | 156/442.1 |
| 4,874,938 | 10/1989 | Chuang | 250/303 R |
| 5,024,180 | 6/1991 | Roman | 118/246 |

OTHER PUBLICATIONS

Webster's II New Riverside University Dictionary, 1984, Houghton Mifflin Company.

*Primary Examiner*—W. Gary Jones
*Assistant Examiner*—Todd J. Burns

[57] ABSTRACT

A liquid applicator with reservoir within a housing with a slot through which the material, or in this embodiment, the envelope flap, is drawn to activate the previously applied adhesive thereon.

31 Claims, 1 Drawing Sheet

SECTION A-A

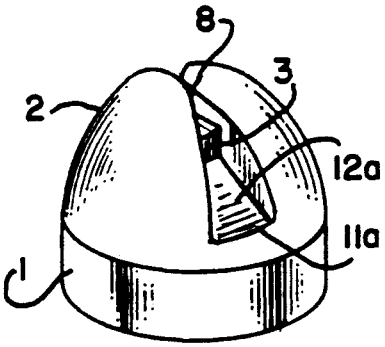
FIG. 1
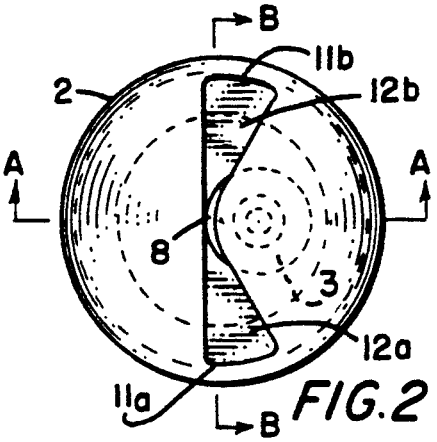
FIG. 2
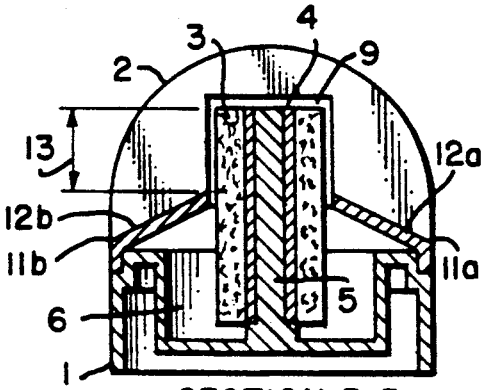
SECTION B-B
FIG. 4
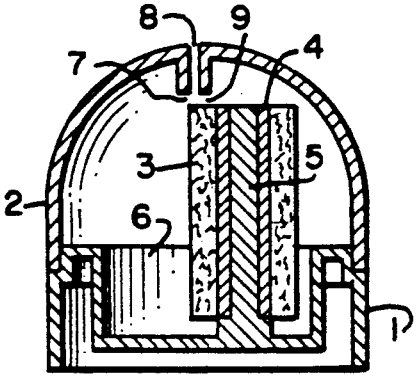
SECTION A-A
FIG. 3
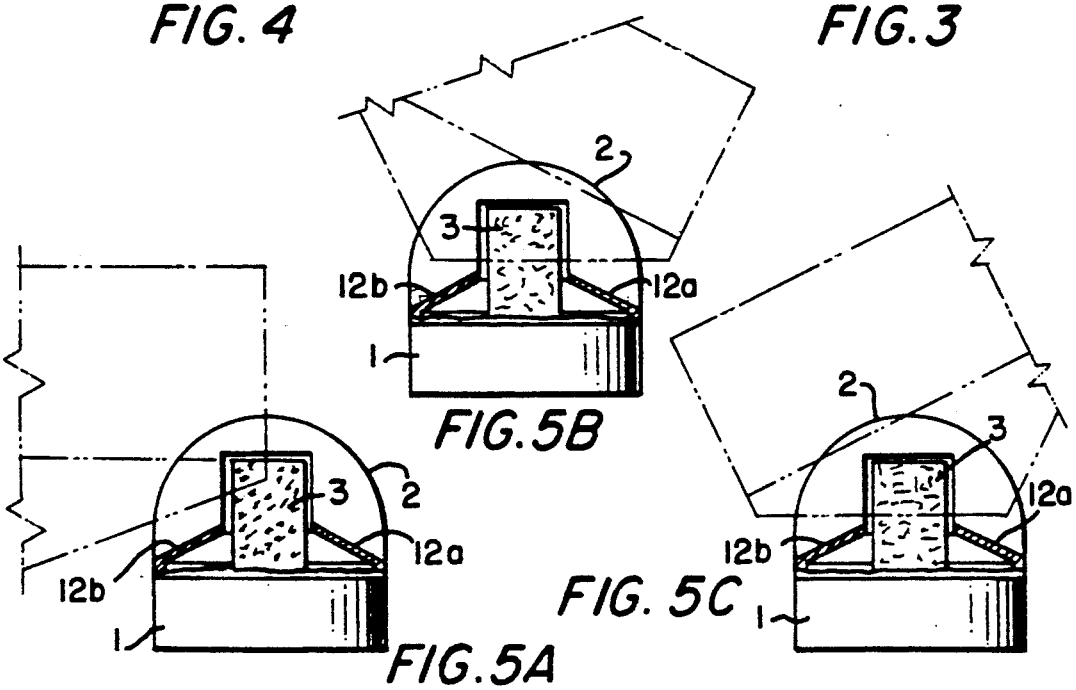
FIG. 5B
FIG. 5C
FIG. 5A

LIQUID APPLICATOR TO ACTIVATE ADHESIVE

BACKGROUND OF THE INVENTION

1. Field of Invention

The present Invention relates to moistening and sealing envelopes. More specifically, the present invention relates to a liquid applicator for activating the adhesive on envelope flaps.

2. Prior Art

Millions of envelopes in a variety of sizes and shapes are moistened and sealed on a weekly basis in the payment of and mailing of bills, sending of notices and greetings, and the mailing of letters by homes, offices and institutions. Such moistening ranges from the use of the tongue to highly sophisticated computer controlled spray methods used for the high speed machines. The very uncertain taste of the envelope flap adhesive and the very real possibility of getting a painful cut on the tongue lead to considering a simple and convenient alternate.

U.S. Design Pat. #247,231 is an approach that provides a moistening surface but one that is subject to rapid evaporation.

U.S. Design Pat. #4,428,794 provides for a moistening method as an integral part of a sealing machine with a multiplicity of parts including moving parts.

U.S. Pat. No. #5,007,371 provides for electronic controls of a spray moistening system within a highly automated piece of machinery.

No device is known that combines the features of a manually fed moistening surface with an attractive enclosure which minimizes evaporation from the moistening surface, provides positive contact between the adhesive and moistening surfaces and minimizes any spillage from the liquid reservoir.

SUMMARY OF THE INVENTION

The principal object of the present invention is to provide the user with a safe and convenient alternate to the use of the tongue for moistening envelope flaps.

It also is an object of the present invention to provide a device with an adequate liquid reservoir and a moisturizing surface with minimum evaporation and wear.

It is also an object of the present invention to be attractive and economical for the user and to use.

A further object is to provide a convenient way to refill the reservoir and to minimize any spillage should the device be upset.

The foregoing objects can be accomplished by the following: The moistening device consists of an applicator within a container. The lower half of the container provides a reservoir for the moistening agent and a support for the applicator. The top half seals firmly with the bottom half enclosing the container and includes a shaped area with limited opening through which the surface with adhesive is guided and comes in contact with the applicator. The limited opening minimizes loss of the moistening agent by evaporation or spillage. The applicator, one end of which resides in the moistening agent, carries the moistening agent by capillary action to the area of application.

For example, if the item to be moistened is an envelope flap, the flap is drawn from one side to the other. The shaped and limited opening controls the application of the moistening agent to the adhesive coated surface. After removel, the flap is folded over and sealed with pressure. Any flap shape can be guided through the shaped opening.

BRIEF DESCRIPTION OF THE DRAWINGS

FIG. 1 is a typical view of a preferred configuration of a liquid applicator to activate adhesive in accordance with the present invention.

FIG. 2 is a top view of FIG. 1

FIG. 3 is cross section A—A through FIG. 2

FIG. 4 is cross section B—B through FIG. 2

FIGS. 5A, 5B, 5C are partially exposed views of the present invention showing positions of the envelope flap passing through the invention from left to right.

DETAILED DESCRIPTION

As shown in the drawings a preferred embodiment of the liquid applicator to activate adhesive in accordance with the present invention includes a shaped lower housing 1 that acts as a reservoir 6 for the moistening agent and provides a shaft 5 around which the applicator 3 is free to rotate in either direction and a shaped upper housing 2 which includes shaped areas 12A, 12B so configured to allow movement of the envelope flap in either direction and ensuring contact between the applicator 3 and the adhesive on the flap within the slot 8. The shaft 5 for the applicator 3 is off center in the lower housing 1 to conform with the slot 8 and shaped areas 12A, 12B through which the envelope flap is drawn. The applicator 3 is composed of such a material as to carry the moistening agent from the reservoir 6 to the limited width of application 13 on a continuing basis and may include a sleeve 4 with an inside diameter to loosely fit the shaft 5. The replaceable applicator 3 is allowed to rotate freely providing a fresh surface of moistening agent as the adhesive coated flap passes through. The shaped areas 12A, 12B beginning at 11A,11B guide the envelope flap up and into slot 8 where a limited width 13 of the applicator 3 comes in contact with the flap and applies the moistening agent to the adhesive. The shaped areas 12A, 12B are wider and lower at 11A and 11B on either side to facilitate entering the envelope flap from either side narrowing down and rising to the restricted slot 8 that confines the flap where it lightly compresses the applicator 3 and is held in contact with the rotating applicator 3 as is passes through. The nominal slot 8 and minimum openings, 7, 9 around the applicator 3 minimize evaporation of the moistening agent and prevent contact between the user and the applicator 3, as well as minimizing spillage should the device be upset. A bayonet type fastening, or similar known technique, would be used to assure the proper orientation between the upper housing 2 and lower housing 1 as required by the off-center location of the applicator 3. Except for the capillary applicator 3 carrying the moistening agent from the reservoir 6 to the area of application 13, the material of choice for making the invention is likely to be some form of moldable material.

The foregoing description of a preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A device for moistening an adhesive coating on a thin workpiece with a moistening agent, comprising:

a housing for holding said moistening agent;

an applicator means mounted in said housing and having a lateral surface for carrying and applying said moistening agent to said workpiece, said lateral surface being at least partially accessible by said workpiece, said lateral surface being curved; wherein said applicator means comprises a material having as a property the ability to carry said moistening agent by capillary action;

said housing has a slot with a pair of opposing upright walls leading toward an opening for exposing said lateral surface at least partially, said opening having a limited size for preventing exposure of said lateral surface throughout most of said slot, so that loss of the agent through said opening is limited.

2. A device according to claim 1, wherein:

said slot comprises means for guiding said workpiece past said applicator means to compress said material a predetermined amount.

3. A device according to claim 1, wherein:

said slot comprises means for guiding said workpiece to approach said applicator means from one of two predetermined directions and to compress said material a predetermined amount.

4. A device according to claim 1, wherein:

said slot comprises means for guiding said workpiece relative to said applicator means to (a) apply moisture to a limited width on said workpiece, and (b) compress said material a predetermined amount.

5. A device according to claim 1, wherein:

said applicator means has an upper and a lower end;

said slot comprises means for guiding said workpiece past said upper end of said applicator means; and said applicator means is arranged to carry to said upper end the moistening agent pooled at said lower end.

6. A device according to claim 1 wherein said applicator means is mounted in said housing to rotate about an upright axis and roll over said workpiece to moisten said adhesive coating.

7. A device according to claim 1 wherein: said housing comprises a shaft mounted upright in said housing to rotatably support said applicator means.

8. A device according to claim 1 wherein said applicator means is removable and replaceable by lifting said sleeve with said material off said shaft, so that the material can be replaced when worn.

9. A device according to claim 1 wherein: said applicator means comprises a sleeve rotatably mounted about said shaft, said material being mounted around said sleeve, said sleeve and said material being removable and replaceable by lifting said sleeve with said material off said shaft, so that the material can be replaced when worn.

10. A device according to claim 1 wherein said upright walls converge toward said opening.

11. A device according to claim 10 wherein said one of said upright walls is straight and the other one inflects toward said opening.

12. A device according to claim 11 wherein said slot has a floor between said walls, said floor being inclined upwardly towards said opening.

13. A device according to claim 1 wherein: said housing comprises a cup-shaped lower reservoir; and a housing cover detachably secured to said lower reservoir.

14. A device according to claim 13 wherein said housing cover has a domed portion surrounding said slot.

15. A device according to claim 1 wherein: said applicator means is offcentered in said housing.

16. A device, according to claim 1, wherein:

said housing comprises a cup-shaped reservoir; and a housing cover detachably secured to said lower reservoir;

said slot comprises means for guiding said workpiece; and said slot is offset from said applicator means.

17. A device for moistening an adhesive coating on a thin workpiece with a moistening agent, comprising:

a housing for holding said moistening agent; and an applicator means mounted in said housing and having a lateral surface for carrying and applying said moistening agent to said workpiece;

said housing having a slot with a pair of opposing upright walls converging toward said opening exposing, at least partially, said lateral surface.

18. A device according to claim 17 wherein said applicator means comprises a material having as a property the ability to carry said moistening agent by capillary action.

19. A device, according to claim 18, wherein:

said walls comprise means for guiding said workpiece past said applicator means to compress said material a predetermined amount.

20. A device according to claim 19 wherein: said applicator means is offcentered in said housing.

21. A device, according to claim 20, wherein:

said housing comprises a cup-shaped reservoir; and a housing cover detachably secured to said lower reservoir, said cover having said slot formed therein for guiding said workpiece, and said slot being offset from said applicator means.

22. A device according to claim 19 wherein: said housing comprises a cup-shaped lower reservoir; and a housing cover detachably secured to said lower reservoir.

23. A device according to claim 22 wherein: said housing cover has a domed portion surrounding said slot.

24. A device, according to claim 18, wherein:

said walls comprise means for guiding said workpiece to approach said applicator means from one of two predetermined directions and to compress said material a predetermined amount.

25. A device, according to claim 18, wherein:

said walls comprise means for guiding said workpiece relative to said applicator means to (a) apply moisture to a limited width on said workpiece, and (b) compress said material a predetermined amount.

26. A device, according to claim 18 wherein:

said applicator means has an upper and lower end; and said walls comprise means for guiding said workpiece past said upper end of said applicator means, said applicator means being arranged to carry to said upper end the moistening agent pooled at said lower end.

27. A device according to claim 18 wherein said applicator means is removable and replaceable by lifting, so that the material can be replaced when worn.

28. A device, according to claim 18, wherein:

said upright walls lead toward an opening for exposing said lateral surface, at least partially, said opening having a limited size for preventing exposure of said lateral surface throughout most of said slot, so that loss of the agent through said opening is limited.

29. A device according to claim 28 wherein said upright walls converge toward said opening.

30. A device according to claim 29 wherein said one of said upright walls is straight and the other one inflects toward said opening.

31. A device according to claim 30 wherein: said slot has a floor between said walls, said floor being inclined upwardly towards said opening.

* * * * *